US012196081B2

(12) United States Patent
Al-Mousa

(10) Patent No.: US 12,196,081 B2
(45) Date of Patent: Jan. 14, 2025

(54) NON-METALLIC LINER FOR WELLBORE SIDETRACK OPERATIONS

(71) Applicant: Saudi Arabian Oil Company, Dhahran (SA)

(72) Inventor: Ahmed Abdulaziz Al-Mousa, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/332,397

(22) Filed: Jun. 9, 2023

(65) Prior Publication Data

US 2024/0410227 A1 Dec. 12, 2024

(51) Int. Cl.
*E21B 7/06* (2006.01)

(52) U.S. Cl.
CPC ..... *E21B 7/061* (2013.01)

(58) Field of Classification Search
CPC ..... E21B 7/061
See application file for complete search history.

(56) References Cited

U.S. PATENT DOCUMENTS 5,564,503 A * 10/1996 Longbottom ..... E21B 33/1293 166/117.6
5,649,595 A * 7/1997 Davis ..... E21B 41/0042 166/55.6
5,785,133 A * 7/1998 Murray ..... E21B 41/0035 175/82
7,168,494 B2 1/2007 Starr et al.
7,828,062 B2 11/2010 Budney
2002/0195249 A1* 12/2002 Murray ..... E21B 7/06 166/50
2003/0089499 A1* 5/2003 Ohmer ..... E21B 29/06 166/117.6
2013/0292110 A1* 11/2013 Fraser ..... E21B 7/061 166/321
2013/0333876 A1* 12/2013 Dancer ..... E21B 17/08 166/242.6
2015/0007993 A1* 1/2015 Parlin ..... E21B 7/061 166/117.5
2018/0274300 A1* 9/2018 Vemuri ..... E21B 43/14
2023/0272672 A1* 8/2023 Al-Mousa ..... E21B 21/103 166/117.6
2023/0383604 A1* 11/2023 Al-Mousa ..... E21B 23/06

FOREIGN PATENT DOCUMENTS

CA 2527390 7/2010

* cited by examiner

*Primary Examiner* — Shane Bomar
(74) *Attorney, Agent, or Firm* — Fish & Richardson P.C.

(57) ABSTRACT

A non-metallic liner for wellbore sidetrack operations is included in a wellbore tool assembly. The assembly includes a wellbore milling bottom hole assembly (BHA) that can mill through a wellbore liner material and material softer than the wellbore liner material. The assembly includes a wellbore liner that can be installed within a main well. The wellbore liner includes a first length segment made of the wellbore liner material and a second length segment axially attached to the first length segment. The second length segment is made of the non-metallic material. A window to form a lateral well is in the second length segment. The assembly includes a whipstock that can be installed within the main well in the first length segment of the wellbore liner after the wellbore milling BHA has milled the second length segment. The whipstock can guide the wellbore milling BHA towards the window.

19 Claims, 5 Drawing Sheets

NON-METALLIC LINER FOR WELLBORE SIDETRACK OPERATIONS

TECHNICAL FIELD

This disclosure relates to wellbore operations, and particularly to wellbore operations performed to form lateral wells.

BACKGROUND

A well system can include a main well and one or more lateral wells extending from a side wall of the main well. After casing the main well, a location to form a window in the casing of the main well is identified. A whipstock is installed within the casing at a location below the window. The whipstock allows sidetracking the lateral well through the window. The window can be milled using a milling bottom hole assembly (BHA) lowered into the main well. The milling BHA can also be used to enlarge a top of a liner at a location uphole of the window.

SUMMARY

This specification describes technologies relating to a non-metallic liner for wellbore sidetrack operations.

Certain aspects of the subject matter described here can be implemented as a wellbore tool assembly. The assembly includes a wellbore milling bottom hole assembly (BHA) that can mill through a wellbore liner material and material softer than the wellbore liner material. The assembly includes a wellbore liner that can be installed within a main well. The wellbore liner includes a first length segment made of the wellbore liner material and a second length segment axially attached to the first length segment. The second length segment is made of the material softer than the wellbore liner material. A window to form a lateral well is in the second length segment. The assembly includes a whipstock that can be installed within the main well in the first length segment of the wellbore liner after the wellbore milling BHA has milled the second length segment. The whipstock can guide the wellbore milling BHA towards the window.

An aspect combinable with any other aspect includes the following features. When installed within the main well, the second length segment is uphole of the first length segment.

An aspect combinable with any other aspect includes the following features. The system includes a wellbore liner hanger that can be installed within the main well and can support the wellbore liner downhole of the wellbore liner hanger.

An aspect combinable with any other aspect includes the following features. The assembly includes a packer that can be positioned within the wellbore liner hanger and can be positioned at a location within the main well. The packer can isolate portions of the main well uphole of the location from portions of the main well downhole of the location.

An aspect combinable with any other aspect includes the following features. An uphole end of the wellbore liner is connected to the packer by a metal-to-metal seal.

An aspect combinable with any other aspect includes the following features. A downhole end of the second length segment is connected to an uphole end of the first length segment by a metal-to-metal seal.

An aspect combinable with any other aspect includes the following features. The assembly includes a wellbore cleaning sub-assembly that can be run into the wellbore liner to clean debris from the milling BHA milling the second length segment.

An aspect combinable with any other aspect includes the following features. The wellbore cleaning sub-assembly includes a wellbore tubing that can run from a surface of the well to a depth at which the second length segment was installed within the main well, and a wellbore fluid that can be flowed through the wellbore tubing into the main well to clean the debris.

Certain aspects of the subject matter described here can be implemented as a method. A wellbore liner that includes a first length segment and a second length segment is formed. The first length segment is made of a wellbore liner material. The second length segment is made of a material softer than the wellbore liner material. The first length segment is axially attached to the second length segment. The wellbore liner is run into and installed in a main well. When installed, the second length segment is uphole of the first length segment, and a window to form the lateral well is at a depth at which the second length segment is installed within the main well. The second length segment is milled through using a wellbore milling bottom hole assembly (BHA) to access the window. After milling through the second length segment to access the window, the lateral well is formed through the window.

An aspect combinable with any other aspect includes the following features. The first length segment is not milled through.

An aspect combinable with any other aspect includes the following features. An entirety of the second length segment is milled through.

An aspect combinable with any other aspect includes the following features. To install the wellbore liner, an annulus between an outer surface of the wellbore liner and an inner surface of the main well is cemented.

An aspect combinable with any other aspect includes the following features. To form the lateral well from the window, a whipstock is run into the main well and installed in the first length segment. The window is milled through to form the lateral well.

An aspect combinable with any other aspect includes the following features. To install the wellbore liner in the main well, a wellbore liner hanger is installed in the main well, and the wellbore liner is supported from the wellbore liner hanger.

An aspect combinable with any other aspect includes the following features. A packer is installed at a location within the main well. The packer can isolate portions of the main well uphole of the location from portions of the main well downhole of the location. An uphole end of the second length segment is connected to the packer by a metal-to-metal seal.

An aspect combinable with any other aspect includes the following features. Using the milling BHA, the packer and a top of the wellbore liner are milled through before milling through the second length segment.

An aspect combinable with any other aspect includes the following features. A downhole end of the second length segment is connected to an uphole end of the first length segment by a metal-to-metal seal.

An aspect combinable with any other aspect includes the following features. After milling through the second length segment and before forming the lateral well, debris within the main well, resulting from milling through the second length segment, is cleaned.

An aspect combinable with any other aspect includes the following features. To clean the debris, well fluid is flowed from a surface to the depth at which the second length segment is installed within the main well.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

To form a lateral well from a main well, a wellbore liner is first lowered into and installed in the main well. The wellbore liner can include a sidetrack profile, which is positioned at a depth within the main well from which the lateral well is to be formed. The position of the sidetrack profile within the main well defines a window in a sidewall of the main well. The lateral well can formed through the window by a milling bottom hole assembly (BHA). Forming the lateral well can also involve milling through a top of the wellbore liner to access the sidetrack profile.

Wellbore liners can be made using materials which can survive wellbore conditions (e.g., high temperatures and pressures, corrosive nature of well fluids such as hydrocarbons, drilling mud, and the like). Examples of such materials include metals such as alloy steels. Milling through such materials can not only be time consuming but also result in wear of the milling tools.

This disclosure describes a wellbore liner that is made of two different axial length segments, each of which is made of a different material. A first axial length segment is made of a first material which can survive wellbore conditions such as that described above. A second axial length segment, which is axially attached to the first axial length segment, is made of a second material that is softer than the first. The sidetrack profile is formed in the second axial length segment. When such a wellbore liner is installed within a main well, the milling BHA can mill through the softer material of the second axial length segment more easily than through the comparatively harder material of the first axial length segment. Consequently, a time to form, and wear and tear of equipment used to form the lateral well can be reduced. In addition, the softer material can reduce a weight of the wellbore liner, making it easier to lift cuttings resulting from milling the softer material out of the main well.

Figure 1B:
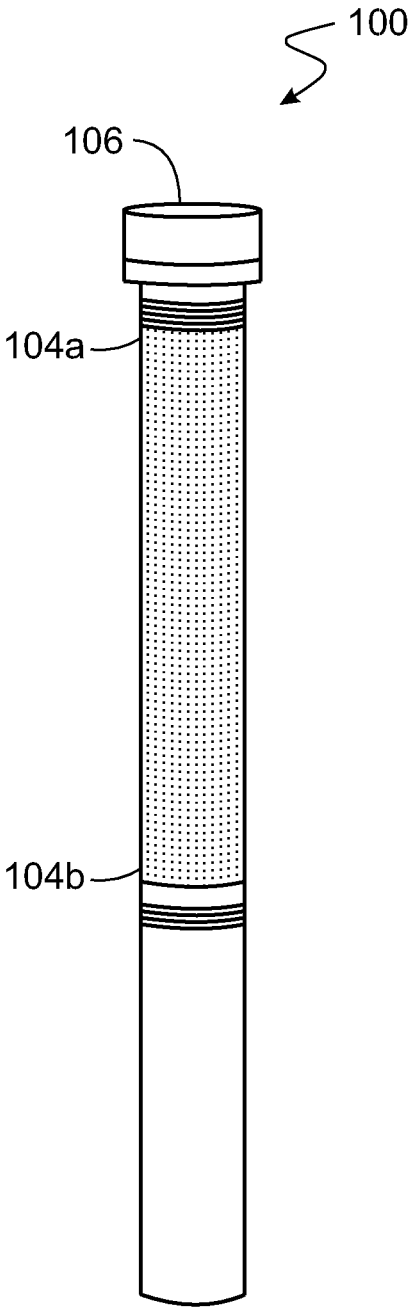
FIGS. 1A and 1B are schematic diagrams of examples of a wellbore liner made of two different materials installed within a main well.
Figure 1A:
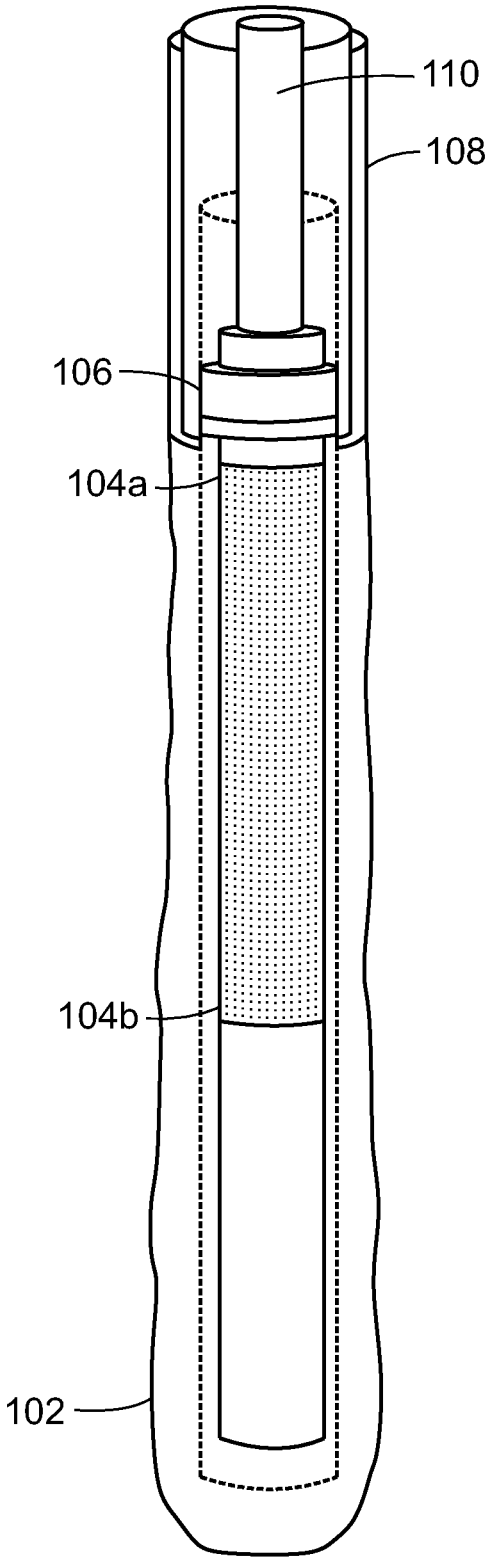

FIGS. 1A and 1B are schematic diagrams of examples of a wellbore liner 100 made of two different materials installed within a main well 102. The main well 102 can be formed from a surface of the Earth through a subterranean zone (e.g., a formation, a portion of a formation, multiple formations). For example, the main well 102 can be formed to a subsurface reservoir in which hydrocarbons are entrapped.

The wellbore liner 100 includes a first length segment 104*a* and a second length segment 104*b*, both of which are axially attached to each other. The first length segment 104*a* is made of a material such as hard metal such as steel. The second length segment 104*b* is made of a comparatively softer material, e.g., a composite, aluminum, fiberglass, to name a few. Both materials can be of a type that can survive wellbore conditions. The material with which the second length segment 104*b* is made can be easier to mill compared to the first material with which the first length segment 104*a* is made. By easier to mill, it is meant that the time taken by a milling tool to mill the second length segment 104*b* is less than the time taken to mill the first length segment 104*a*. In addition, a wear and tear on the milling tool resulting from milling the second length segment 104*b* can be less than a wear and tear resulting from milling the first length segment 104*a*.

Further, a length of the second length segment 104*b* can be selected to accommodate a window of a lateral well (described later). A length of the first length segment 104*a* can be selected according to a well operation to be performed using the first length segment 104*a*. The length of the first length segment 104*a* and the second length segment 104*b* can be based on the formation behind the liner and target coordinates.

In some implementations, the first length segment 104*a* and the second length segment 104*b* are axially connected to each other by threads formed on ends of the two length segments. In some implementations, a packer 106 can be coupled to an end of the second length segment 106*b* opposite from an end to which the first length segment 106*a* is coupled. The packer 106 can be coupled directly to the end. Alternatively, a liner, which is shorter in length compared to the first length segment 104*a* can be positioned between the packer 106 and the end of the second length segment 104*b*.

In some implementations, the wellbore liner 100 can be hung within the main well 102 from a wellbore liner hanger 108 supported by an inner wall of another wellbore tubular (not shown), e.g., a casing. The packer 106 can be installed within the wellbore liner hanger 108 to isolate a portion of the main well 102 downhole of the packer 106 from a portion of the main well 102 uphole of the packer 106. Another liner 110 can be connected uphole of the packer 106 and can be used to flow well fluids from a surface through the liner 110 and the wellbore liner 100. The dimensions of the liner 110, the packer 106 and the second length segment 106*b* can each be of a size sufficient for a milling tool (described later) to mill through.

Figure 2A:
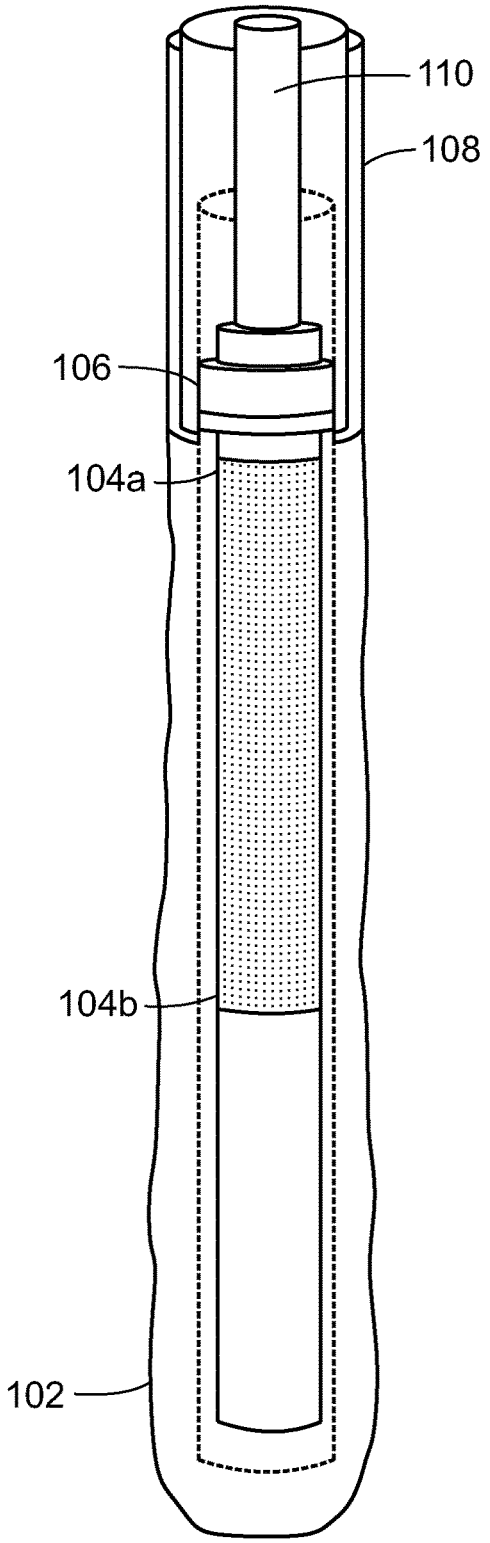
FIGS. 2A-2F are schematic diagrams of examples of forming a lateral well using the wellbore liner of FIGS. 1A and 1B.
Figure 2B:
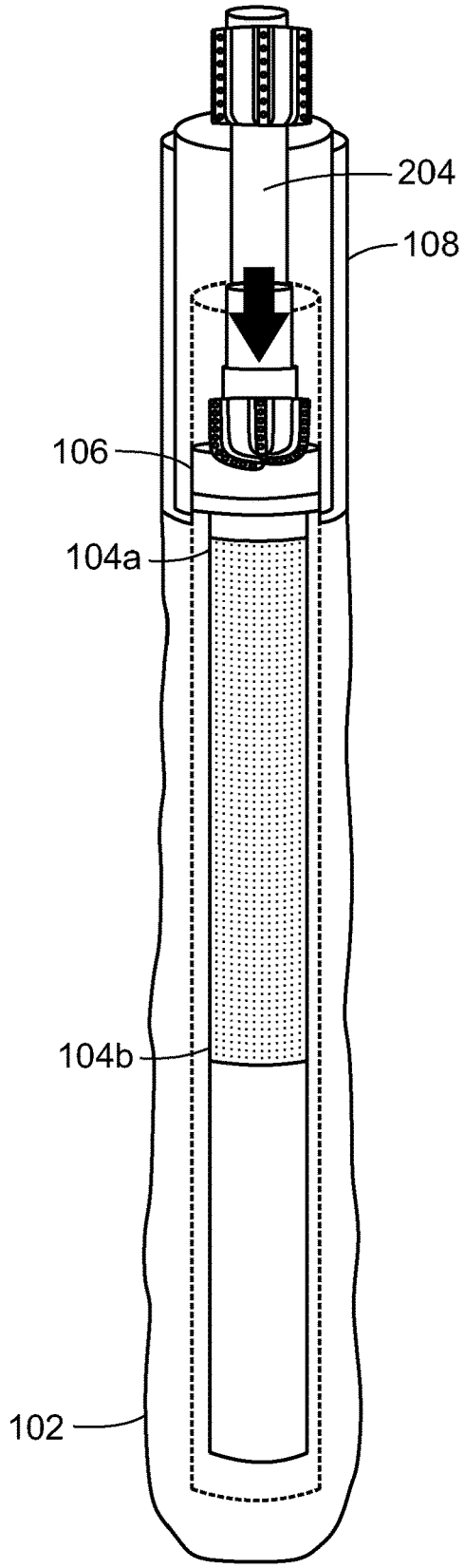

FIGS. 2A-2F are schematic diagrams of examples of forming a lateral well 202 using the wellbore liner 100 of FIGS. 1A and 1B. FIG. 2B shows the wellbore liner 100 installed within the main well 102 as described above with reference to FIGS. 1A and 1B. To install the wellbore liner 100, the liner 100 is first hung from the wellbore liner hanger 108. Then, the annulus between the outer surface of the liner 100 and the inner wall of the wellbore 100 is cemented. In some implementations, only the first length segment 104*a* (i.e., the downhole length segment) can be cemented while the second length segment 104*b* (i.e., the uphole length segment) is not cemented.

FIG. 2B shows an example of a milling bottom hole assembly (BHA) 204, which includes a milling tool, being deployed to mill through the second length segment 104*b*. The milling BHA 204 can be run into the main well 102 from a surface. The milling tool in the milling BHA 204 can mill through a top of the liner 110, the packer 106, and the second length segment 104*b* of the wellbore liner 100. Because the second length segment 104*b* is made of a softer material compared to the first length segment 104*a*, the milling operation takes less time, and the milling BHA 204 experiences less wear and tear.

Figure 2C:
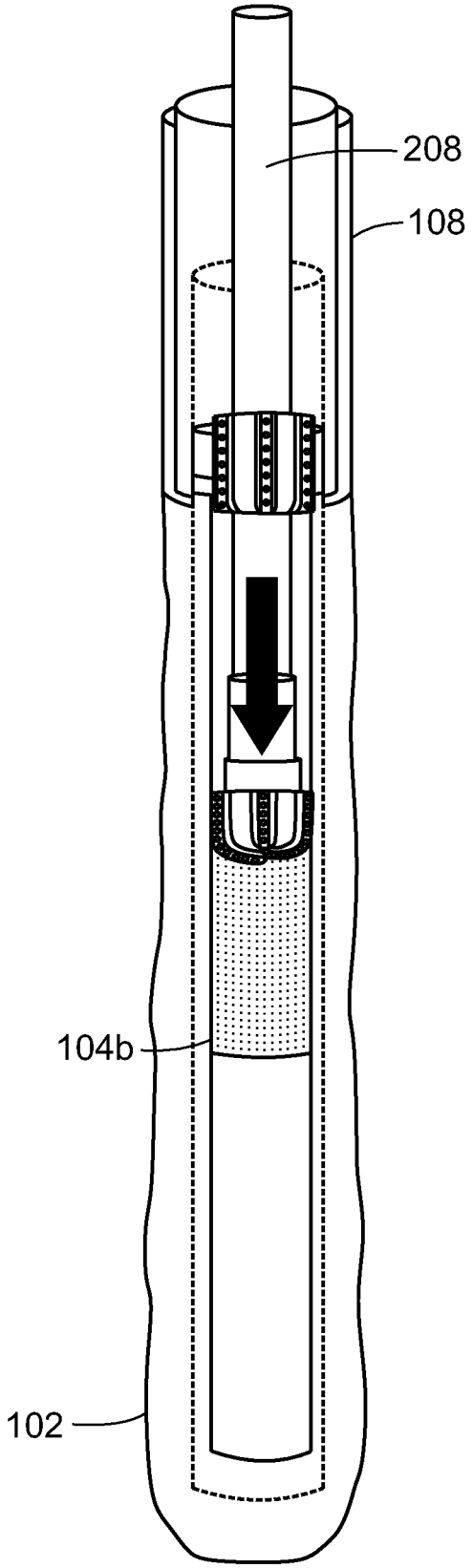

FIG. 2C shows an example of the milling BHA 204 milling the second length segment 104*b*. In some implementations, the milling BHA 204 can be deployed to mill an entirety of the second length segment 104*b*. Alternatively, the milling BHA 204 can be deployed to mill less than an entirety of the second length, the milled portion being sufficient to sidetrack the lateral well 202. In particular, the milling BHA 204 is deployed to drill the second length segment 104*b* (or a sub-portion of the second length segment 104*b*) without also drilling the first length segment 104*a*.

Figure 2D:
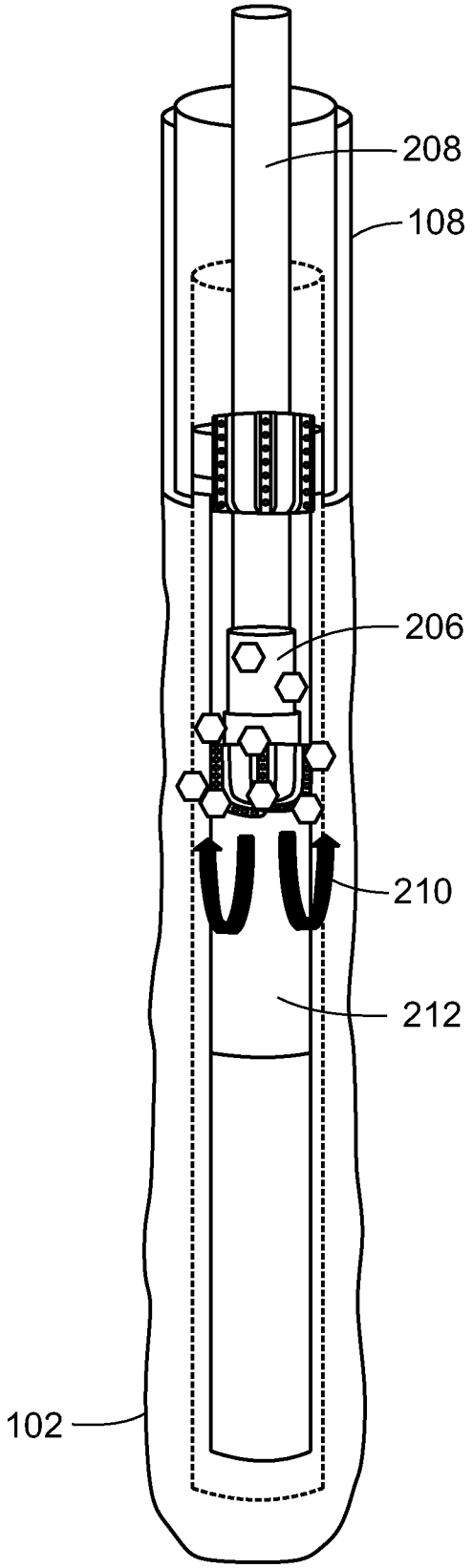

FIG. 2D shows an example of cleaning debris resulting from the milling operations performed using the milling BHA 204. The debris can be cleaned by deploying a cleaning sub-assembly 206 from a surface of the main well 102. For example, the cleaning sub-assembly 206 can include a tubular 208 that can flow a cleaning fluid (e.g., water) or other cleaning fluid from the surface of the main well 102. For example, the cleaning sub-assembly 206 can include flow equipment (e.g., a flow pump, a reservoir to carry the cleaning fluid) at the surface. The portion of the cleaning sub-assembly 206 deployed within the main well 102 can include ports through which the cleaning fluid is circulated (as schematically represented by the arrows 210) to remove the debris from within the main well 102. Upon completion of milling using the milling BHA 204 and cleaning using the cleaning sub-assembly 206, a 360 degree sidetrack 212 is available to form the lateral well 202. The sidetrack 212 occupies the space previously occupied by the portion of the second length segment 104*b* that was milled by the milling BHA 204.

Figure 2E:
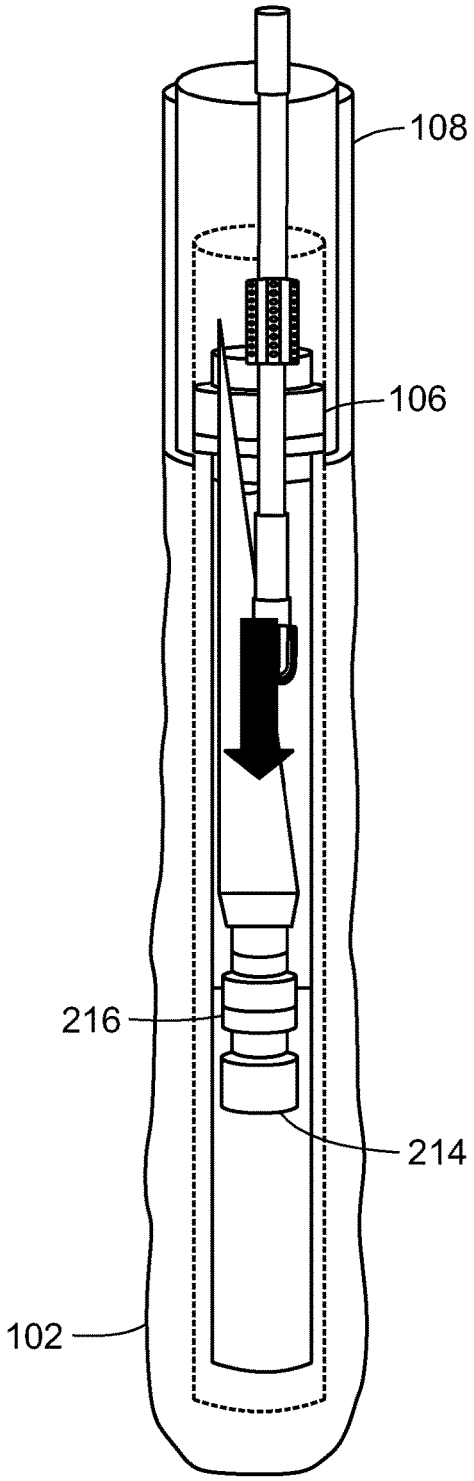
Figure 2F:
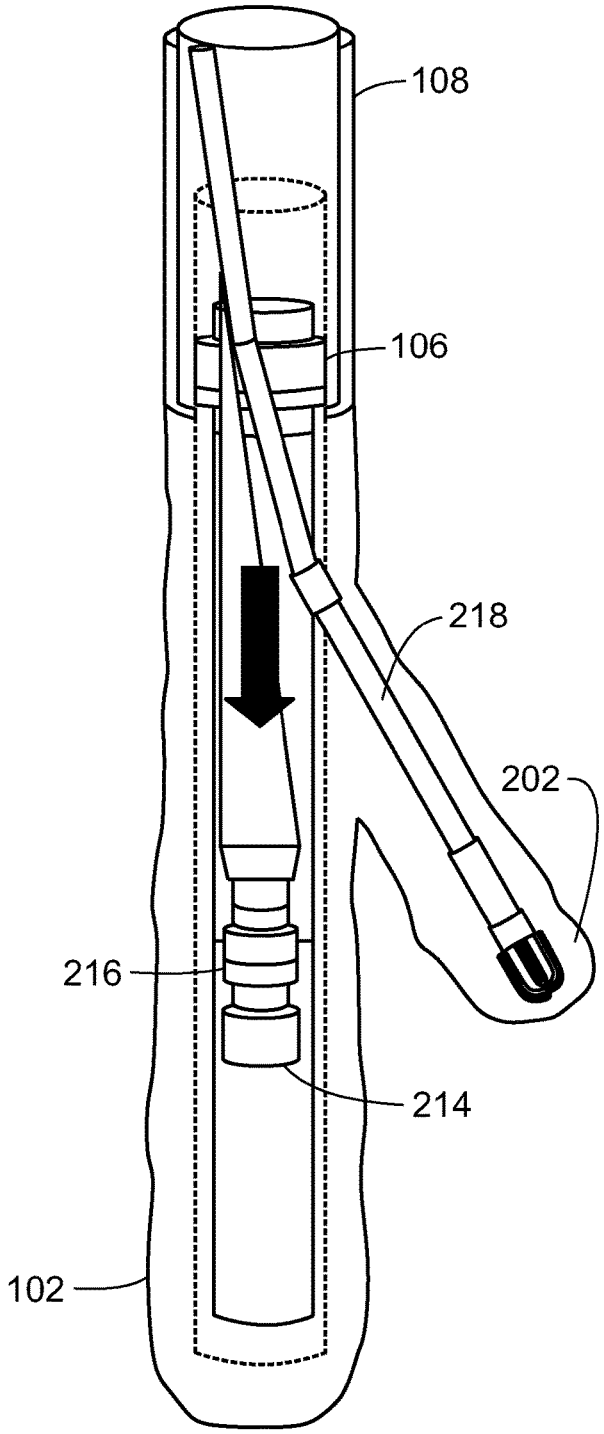

FIGS. 2E and 2F show a whipstock 214 being deployed in the main well 102 after the sidetrack 212 has been formed. In some implementations, the whipstock 214 is lowered to a depth within the main well 102 and more specifically into the first length segment 104*a*. The whipstock 214 includes a packer 216 that can be set at a desired depth in the first length segment 104*a*. In implementations in which less than an entirety of the second length segment 104*b* has been milled, the packer 216 of the whipstock 214 can be set in the remainder of the second length segment 104*b*. A drilling sub-assembly 218 can be deployed from the surface of the main well 102 to form the lateral well 202 through the sidetrack 212.

Figure 3:
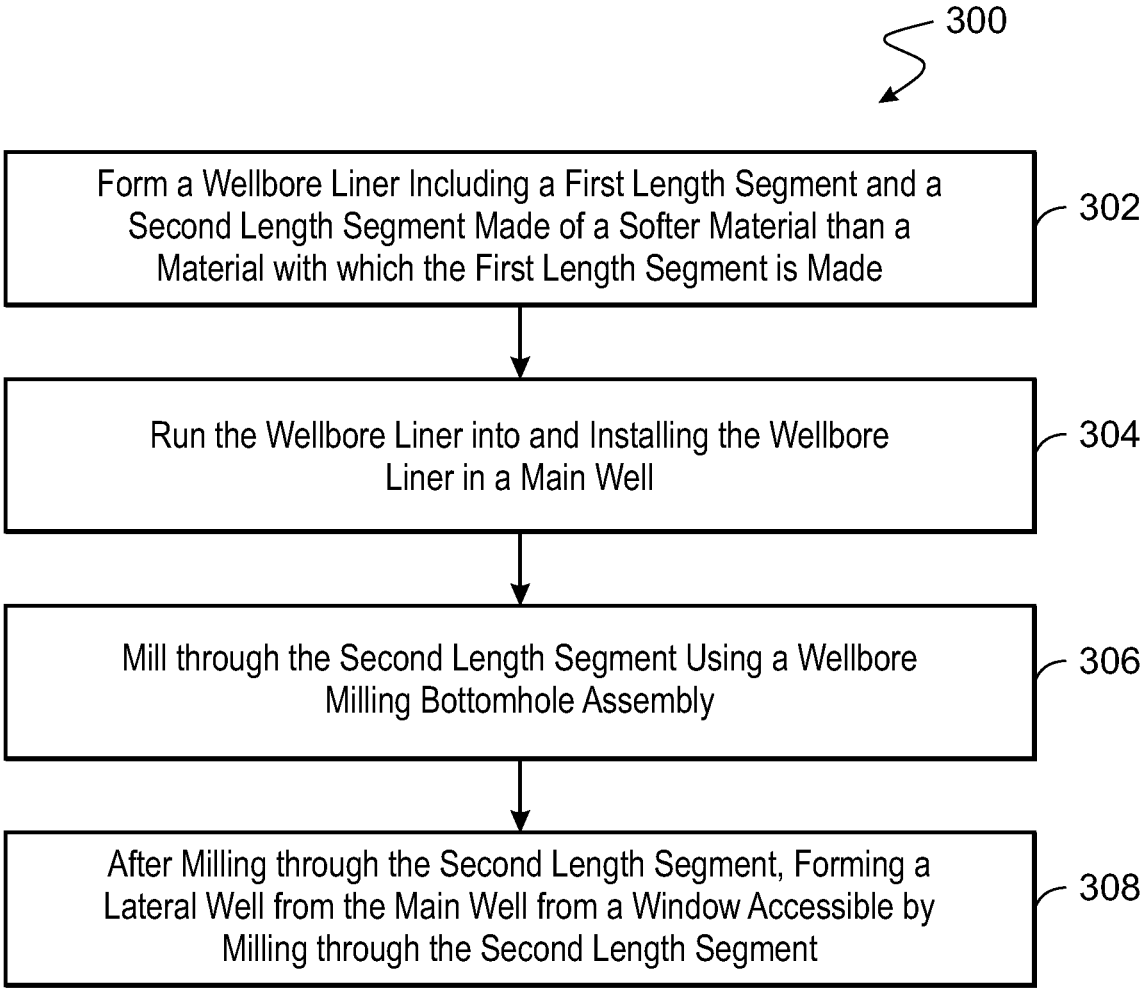
FIG. 3 is a flowchart of an example of a method of forming the lateral well using the wellbore liner of FIGS. 1A and 1B.

FIG. 3 is a flowchart of an example of a method 300 of forming the lateral well using the wellbore liner of FIGS. 1A and 1B. The steps of the method 300 can be performed by a well operator using the well equipment described above with reference to FIGS. 2A-2F. At 302, a wellbore liner that includes a first length segment and a second length segment is formed. The first length segment is made of a wellbore liner material, e.g., steel. The second length segment is made of a material softer than the wellbore liner material, e.g., composite, aluminum. Both materials can operate under wellbore conditions. The first length segment is axially attached to the second length segment. At 304, the wellbore liner is run into and installed in a main well. When installed, the second length segment is uphole of the first length segment. A window to form a lateral well is at a depth at which the second length segment is installed within the main well. At 306, using a milling BHA, the second length segment is milled through to access the window. At 308, after milling through the second length segment to access the window, the lateral well is formed from the window.

Thus, particular implementations of the subject matter have been described. Other implementations are within the scope of the following claims.

The invention claimed is:

1. A wellbore tool assembly comprising:

a wellbore milling bottom hole assembly (BHA) configured to mill through a wellbore liner material and material softer than the wellbore liner material;

a wellbore liner configured to be installed within a main well, the wellbore liner comprising a first length segment made of the wellbore liner material and a second length segment axially attached to the first length segment, the second length segment made of the material softer than the wellbore liner material, wherein a window to form a lateral well is in the second length segment; and a whipstock configured to be installed within the main well in the first length segment of the wellbore liner after the wellbore milling BHA has milled the second length segment, the whipstock configured to guide the wellbore milling BHA towards the window.

2. The assembly of claim 1, wherein, when installed within the main well, the second length segment is uphole of the first length segment.

3. The assembly of claim 1, further comprising a wellbore liner hanger configured to be installed within the main well and to support the wellbore liner downhole of the wellbore liner hanger.

4. The assembly of claim 2, further comprising a packer configured to positioned within the wellbore liner hanger and to be positioned at a location within the main well, the packer configured to isolate portions of the main well uphole of the location from portions of the main well downhole of the location.

5. The assembly of claim 4, wherein an uphole end of the wellbore liner is connected to the packer by a metal-to-metal seal.

6. The assembly of claim 1, wherein a downhole end of the second length segment is connected to an uphole end of the first length segment by a metal-to-metal seal.

7. The assembly of claim 1, further comprising a wellbore cleaning sub-assembly configured to be run into the wellbore liner to clean debris from the milling BHA milling the second length segment.

8. The assembly of claim 7, wherein the wellbore cleaning sub-assembly comprises: a wellbore tubing configured to run from a surface of the well to a depth at which the second length segment was installed within the main well; and a wellbore fluid configured to be flowed through the wellbore tubing into the main well to clean the debris.

9. A method comprising:

forming a wellbore liner comprising a first length segment made of a wellbore liner material and a second length segment made of a material softer than the wellbore liner material, the first length segment axially attached to the second length segment;

running the wellbore liner into and installing the wellbore liner in a main well, wherein, when installed, the second length segment is uphole of the first length segment and a window to form the lateral well is at a depth at which the second length segment is installed within the main well;

milling through the second length segment using a wellbore milling bottom hole assembly (BHA) to access the window; and after milling through the second length segment to access the window, forming the lateral well from the window.

10. The method of claim 9, wherein milling through the second length segment comprises not milling through the first length segment.

11. The method of claim 9, wherein milling through the second length segment comprises milling through an entirety of the second length segment.

12. The method of claim 9, wherein installing the wellbore liner comprises cementing an annulus between an outer surface of the wellbore liner and an inner surface of the main well.

13. The method of claim 9, wherein forming the lateral well from the window comprises:

running into the main well and installing a whipstock in the first length segment; and milling through window to form the lateral well.

14. The method of claim 9, wherein installing the wellbore liner in the main well comprises:

installing a wellbore liner hanger in the main well; and supporting the wellbore liner from the wellbore liner hanger.

15. The method of claim 14, further comprising:

installing a packer at a location within the main well, the packer configured to isolate portions of the main well uphole of the location from portions of the main well downhole of the location; and connecting an uphole end of the second length segment to the packer by a metal-to-metal seal.

16. The method of claim 15, further comprising milling, using the milling BHA, through the packer and a top of the wellbore liner before milling through the second length segment.

17. The method of claim 15, further comprising connecting a downhole end of the second length segment to an uphole end of the first length segment by a metal-to-metal seal.

18. The method of claim 9, further comprising, after milling through the second length segment and before forming the lateral well, cleaning debris within the main well resulting from milling through the second length segment.

19. The method of claim 18, wherein cleaning the debris within the main well comprises flowing well fluid from a surface to the depth at which the second length segment is installed within the main well.

* * * * *